US010471443B2

(12) United States Patent
Chien et al.

(10) Patent No.: US 10,471,443 B2
(45) Date of Patent: Nov. 12, 2019

(54) MAKEUP MACHINE HAVING MULTI-NOZZLE SPRAY HEAD

(71) Applicant: Glory Makeup Inc., Taipei (TW)

(72) Inventors: Ming-Jeh Chien, Taipei (TW); Wen-Hsing Chen, Taipei (TW)

(73) Assignee: GLORY MAKEUP INC., Taipei (TW)

( * ) Notice: Subject to any disclaimer, the term of this patent is extended or adjusted under 35 U.S.C. 154(b) by 137 days.

(21) Appl. No.: 15/822,274

(22) Filed: Nov. 27, 2017

(65) Prior Publication Data

US 2018/0236464 A1 Aug. 23, 2018

(30) Foreign Application Priority Data

Feb. 17, 2017 (TW) ..... 106202345 U

(51) Int. Cl.

| | |
|---|---|
| ***B05B 1/30*** | (2006.01) |
| ***A45D 34/04*** | (2006.01) |
| ***B05B 7/24*** | (2006.01) |
| ***B05B 15/65*** | (2018.01) |
| ***B05B 7/08*** | (2006.01) |
| ***B05B 7/12*** | (2006.01) |
| ***B05B 7/04*** | (2006.01) |
| ***B05B 13/04*** | (2006.01) |

(52) U.S. Cl.

CPC ..... *B05B 1/3013* (2013.01); *A45D 34/04* (2013.01); *B05B 1/3046* (2013.01); *B05B 7/0483* (2013.01); *B05B 7/0876* (2013.01); *B05B 7/0884* (2013.01); *B05B 7/12* (2013.01); *B05B 7/1209* (2013.01); *B05B 7/2494* (2013.01); *B05B 13/0405* (2013.01); *B05B 15/65* (2018.02)

(58) Field of Classification Search

CPC ..... B05B 7/1209; B05B 1/3013; B05B 15/65; B05B 13/0405; B05B 7/2494; B05B 7/12; B05B 7/0884; B05B 7/0876; B05B 7/0483; B05B 1/3046; A45D 34/04; A45D 44/005; A45D 2044/007

USPC ..... 239/303–305, 307, 308, 319, 346, 353, 239/407, 413, 414, 548, 550

See application file for complete search history.

(56) References Cited

U.S. PATENT DOCUMENTS

| | | | | |
|---|---|---|---|---|
| 6,325,302 | B1 * | 12/2001 | Guzowski | B05B 1/14 239/550 |
| 9,597,702 | B1 * | 3/2017 | Ciervo | B05B 17/0607 |
| 2004/0163589 | A1 * | 8/2004 | Kistler | B05B 12/10 239/74 |

* cited by examiner

*Primary Examiner* — Steven J Ganey

(74) *Attorney, Agent, or Firm* — McClure, Qualey & Rodack, LLP

(57) ABSTRACT

A makeup machine includes a multi-nozzle spray head and a plurality of needle valves. The multi-nozzle spray head has a main body and a plurality of nozzles. Each of the nozzles includes an interior chamber and an ejection hole, and the interior chamber is communicated with the ejection hole. The needle valves are disposed in the main body and axially aligned with the ejection holes. The needle valves are configured to be axially movable away from the corresponding ejection holes to open the ejection holes and to be axially movable towards the corresponding ejection holes to close the ejection holes. Further, the needle valves are capable of synchronously or individually moving with respect to the main body.

17 Claims, 12 Drawing Sheets

MAKEUP MACHINE HAVING MULTI-NOZZLE SPRAY HEAD

CROSS REFERENCE TO RELATED APPLICATIONS

This application claims the benefits of the Taiwan Patent Application Serial Number 106202345, filed on Feb. 17, 2017, the subject matter of which is incorporated herein by reference.

FIELD OF THE INVENTION

The present invention relates to a makeup machine and, more particularly, to a makeup machine having a multi-nozzle spray head.

DESCRIPTION OF RELATED ART

With the advancement of aesthetic medicine, applying cosmetics is a common way to prettify the facial appearance. In order to create desired and proper facial or eye makeup looks, users have to practice the makeup skills repeatedly. Particularly, many kinds of cosmetics and makeup tools may be required for drawing various types of eyebrows, eye contours, eye shadows, eye lines and so forth. However, it is not easy for users to unfailingly create satisfactory makeup looks due to poor proficiency in applying cosmetics, different locations in which to apply makeup, and different kinds of cosmetics to be used.

For the reasons stated above, several automatic makeup machines have been developed and commercially available. By the program-controlled machine, users can choose the desired makeup look and get the same makeup effect as the chosen one. For most automatic makeup machines, the makeup procedure is performed by spraying makeup materials onto the user's face from a spray head to create various makeup looks. The conventional spray head typically is configured to have a gas inlet pipe, a material feed pipe and a single nozzle. Accordingly, the gas and makeup materials can be supplied into the interior of the spray head through the gas inlet pipe and material feed pipe, and then be sprayed out of the single nozzle.

SUMMARY OF THE INVENTION

The objective of the present invention is to provide a makeup machine having a multi-nozzle spray head.

In accordance with one embodiment, a makeup machine is provided and includes a multi-nozzle spray head and a plurality of needle valves. The multi-nozzle spray head has a main body and a plurality of nozzles. Each of the nozzles includes an interior chamber and an ejection hole, and the interior chamber is communicated with the ejection hole. The needle valves are disposed in the main body and axially aligned with the ejection holes. In particular, the needle valves are configured to be axially movable away from the corresponding ejection holes to open the ejection holes and to be axially movable toward the corresponding ejection holes to close the ejection holes. Further, the needle valves are capable of synchronously or individually moving with respect to the main body.

In accordance with one embodiment, a makeup machine is provided and includes a plurality of spray head assemblies. Each of the spray head assemblies includes a multi-nozzle spray head and a plurality of needle valves. The multi-nozzle spray head has a main body and a plurality of nozzles. Each of the nozzles includes an interior chamber and an ejection hole, and the interior chamber is communicated with the ejection hole. The needle valves are disposed in the main body and axially aligned with the ejection holes. In particular, the needle valves are configured to be axially movable away from the corresponding ejection holes to open the ejection holes and to be axially movable toward the corresponding ejection holes to close the ejection holes. Further, the needle valves are capable of synchronously or individually moving with respect to the main body.

Accordingly, the makeup machines in accordance with the embodiments of the present invention are advantageous because the multi-nozzle spray head includes multiple nozzles each of which is aligned with a needle valve used for controlling the opening or closing of the ejection holes. In the makeup procedure, the needle valves can synchronously move with respect to the main body so as to simultaneously open all the ejection holes of the nozzles, resulting in more uniformly spraying of materials. Alternatively, the needle valves individually move with respect to the main body to independently open the different ejection holes so as to spray different materials at the same location for different makeup looks or makeup steps, thereby reducing the requirement for moving the multi-nozzle spray head and speeding up the makeup procedure of the makeup machine.

These and other features and advantages of the present invention will be further described and more readily apparent from the detailed description of the preferred embodiments which follows.

BRIEF DESCRIPTION OF THE DRAWINGS

The following detailed description of the preferred embodiments of the present invention can best be understood when read in conjunction with the following drawings, in which.

DETAILED DESCRIPTION OF THE PREFERRED EMBODIMENTS

Figure 1:
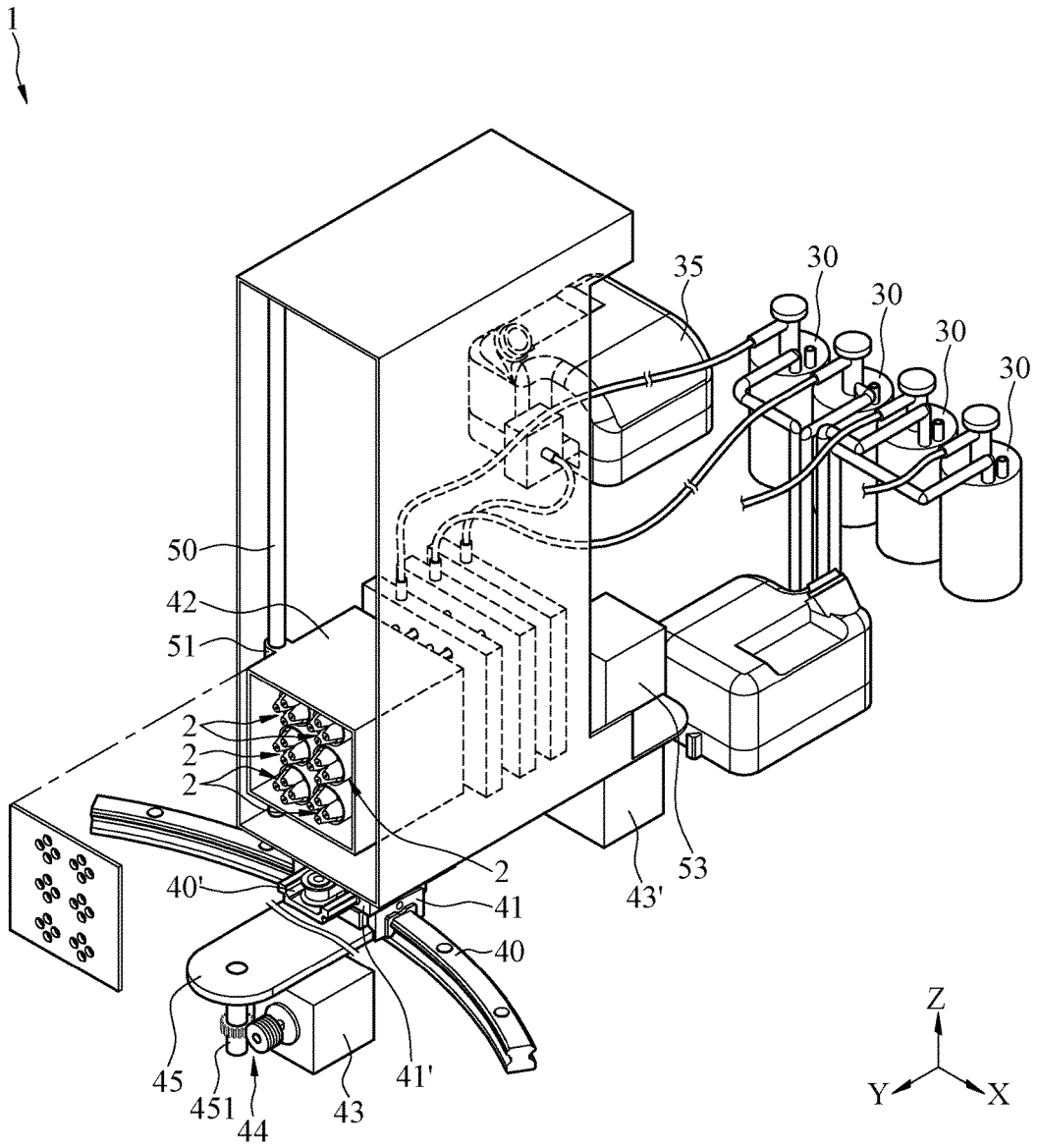
FIG. 1 is a perspective view of a makeup machine at one angular orientation in accordance with one embodiment of the present invention.
Figure 2:
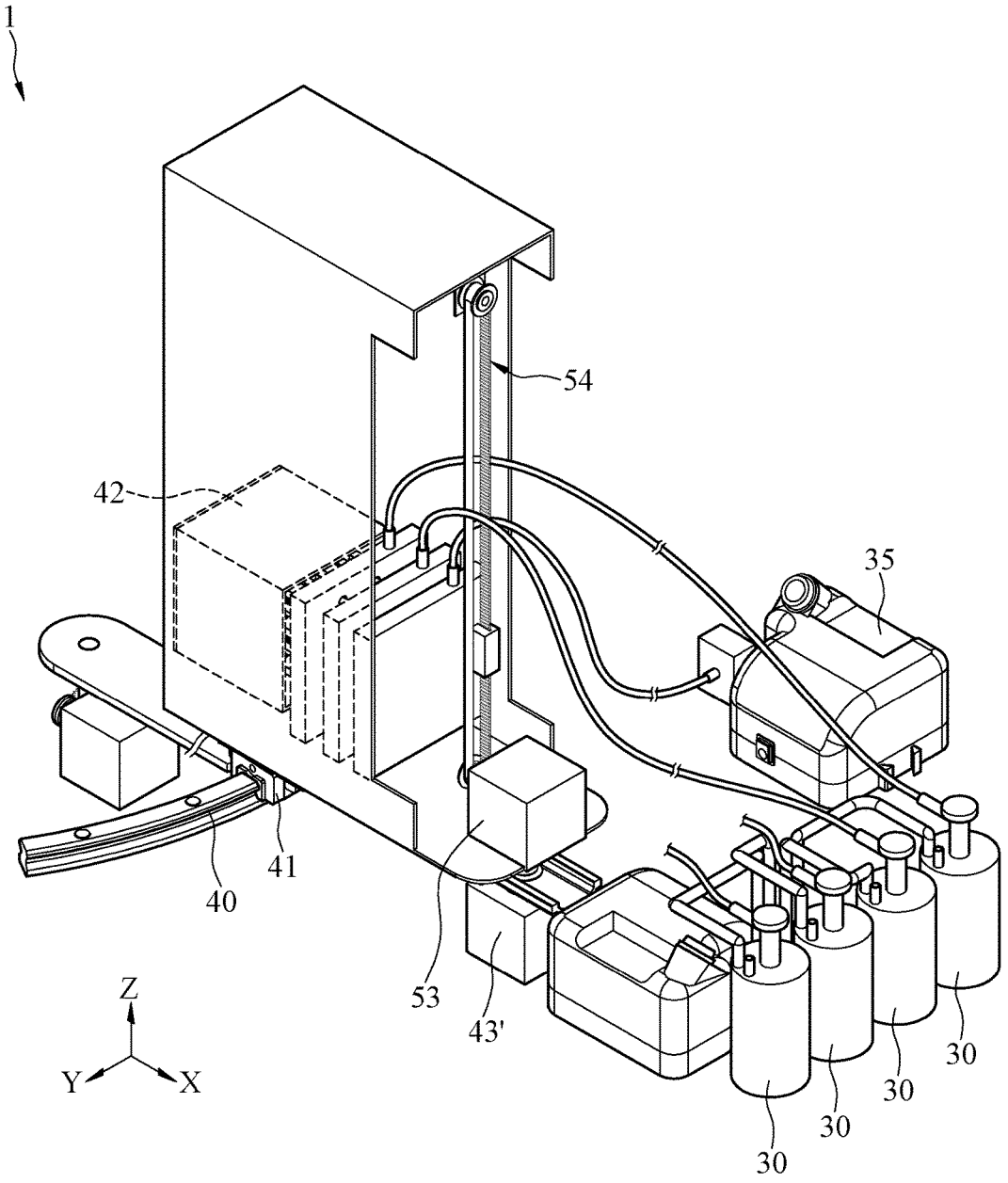
FIG. 2 is a perspective view of a makeup machine at another angular orientation in accordance with one embodiment of the present invention.
Figure 3:
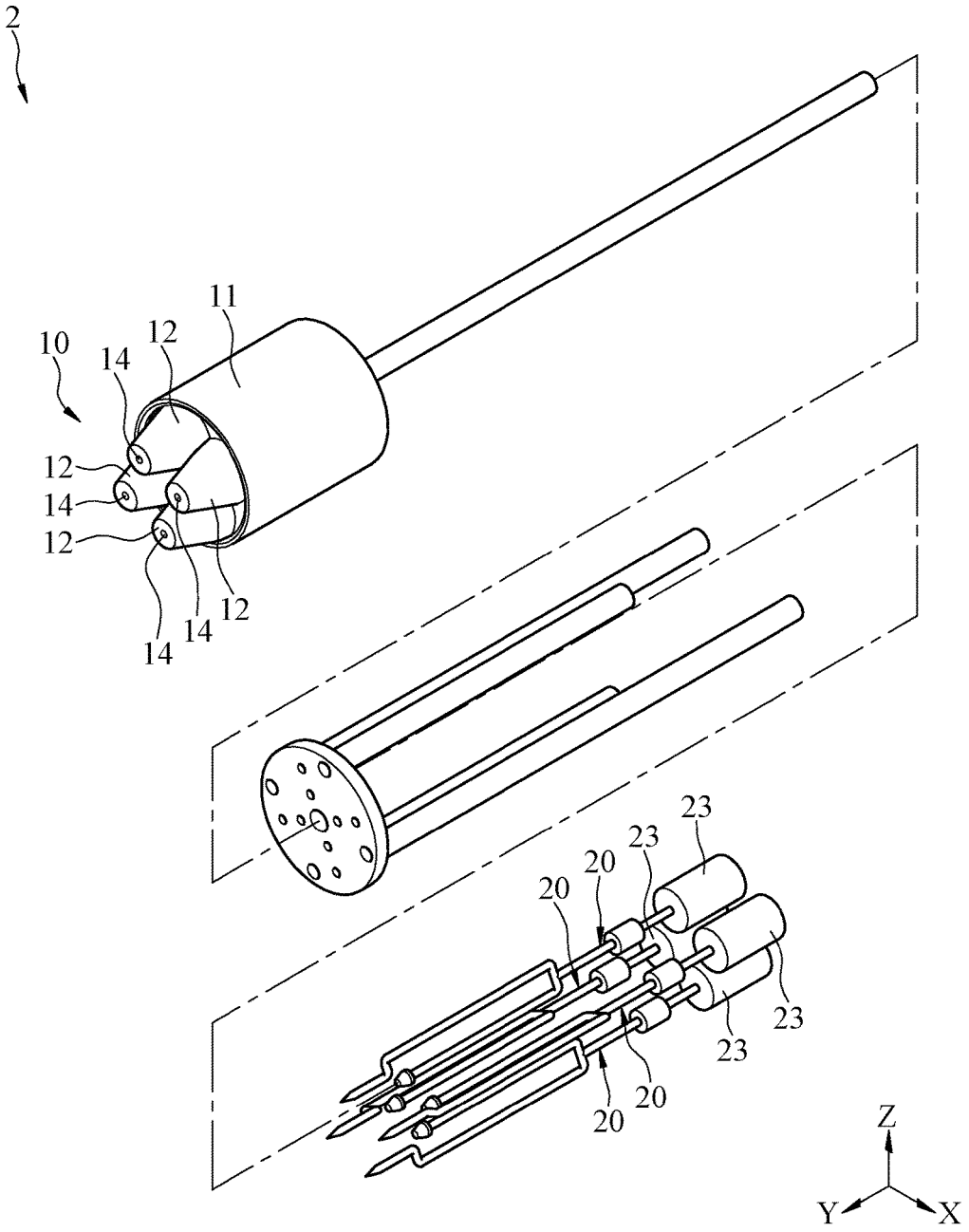
FIG. 3 is an exploded perspective view of a spray head assembly in accordance with the first embodiment of the present invention.
Figure 4:
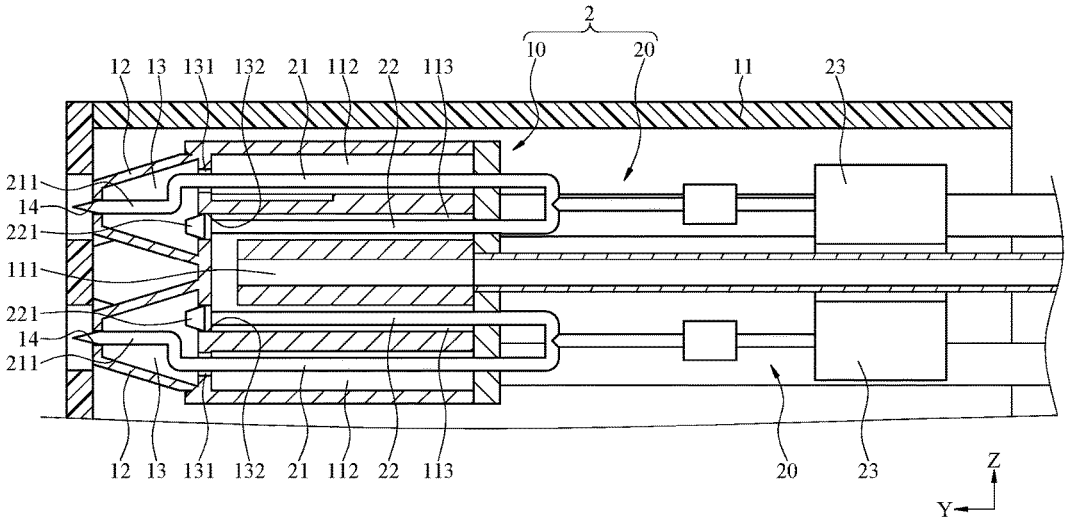
FIG. 4 is a cross-sectional view of a spray head assembly in accordance with the first embodiment of the present invention.

FIGS. 1 and 2 are perspective views of a makeup machine at different angular orientations in accordance with one embodiment of the present invention. FIGS. 3 and 4 are exploded perspective and cross-sectional views, respectively, of a spray head assembly in accordance with the first embodiment of the present invention.

As shown in FIGS. 1, 2 and 3, the makeup machine 1 includes at least one spray head assembly 2. In this embodiment, multiple spray head assemblies 2 are illustrated for exemplary purposes. Each of the spray head assemblies 2 includes a multi-nozzle spray head 10 and a plurality of needle valves 20. Further, the multi-nozzle spray head 10 has a main body 11 and multiple nozzles 12. In one embodiment, the makeup machine 1 includes a standing frame 42 and multiple spray head assemblies 2 stacked in the standing frame 42. The spray head assemblies 2 can be arranged in a linear fashion, a non-linear fashion, a ring fashion or an array fashion.

Figure 6:
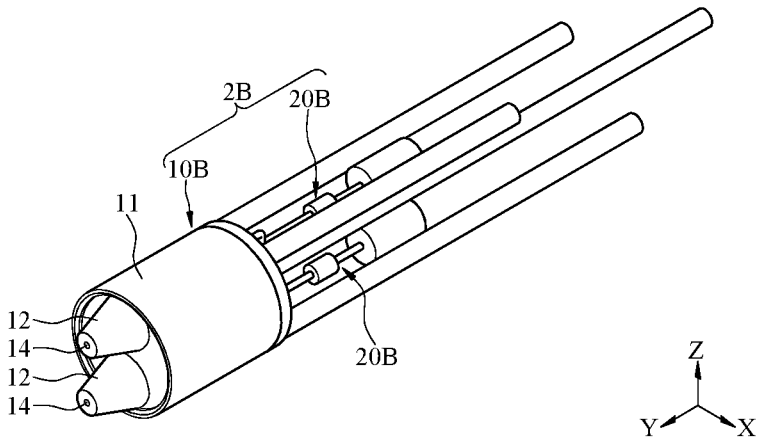
FIG. 6 is a perspective view of a spray head assembly in accordance with the third embodiment of the present invention.

As shown in FIGS. 1, 2 and 3, four nozzles 12 are presented for exemplary illustration of the multi-nozzle spray head 10 in accordance with this embodiment. Specifically, the main body 11 may be a hollow tube, and the nozzles 12 are disposed at one end of the main body 11. In this illustration, the four nozzles 12 are arranged equiangularly. However, in some cases, the nozzles 12 may be arranged in a linear fashion, a non-linear fashion, a ring fashion or an array fashion. The nozzles 12 each include an ejection hole 14, and each of the multi-nozzle spray heads 10 can be connected with one or more material reservoirs 30 and a gas supplier 35 (such as an air pump or gas reservoir). As a result, the multi-nozzle spray heads 10 can receive materials from the material reservoirs 30, and the materials can be sprayed out of the ejection holes 14 under the pressure of the gas supplied from the gas supplier 35 so as to perform a makeup procedure. In some embodiments, the materials received in the material reservoirs 30 may be cosmetics (such as cream foundation, liquid foundation, lipstick, blush, rouge, eyelid cream, cream eyeliner, cream eyeshadow, etc.), toning lotion, face cream, milk lotion, perfume, essence and so forth. Additionally, the materials in the material reservoirs 30 may be in powder, liquid, gel, cream or foam state. The plural needle valves 20 are disposed in the main body 11 and configured to control the opening or closing of the corresponding ejection holes 14. In some cases, the multi-nozzle spray head 10 may include two nozzles 12 or four or more nozzles 12, but is not limited thereto. For instance, as shown in FIG. 6, the multi-nozzle spray head 10B of the spray head assembly 2B includes only two nozzles 12 and two needle valves 20B.

Attention is now directed to FIG. 4, which is a cross-sectional view of the spray head assembly according to the first embodiment of the present invention, in conjunction with FIG. 3. In one embodiment, each nozzle 12 of the multi-nozzle spray head 10 of the spray head assembly 2 includes an isolated interior chamber 13. In other words, all the interior chambers 13 of the nozzles 12 are not communicated with each other, and each interior chamber 13 is communicated with its corresponding ejection hole 14. The interior chambers 13 each include a material inlet 131 and a gas inlet 132. Each of the material inlets 131 may be connected to the same material reservoir 30 such that all the nozzles 12 eject the same material. Alternatively, at least two of the material inlets 131 are connected to different material reservoirs 30 filled with different materials, and thus the two corresponding nozzles 12 can eject different materials. In this embodiment, the main body 11 has multiple material channels 112 and multiple gas channels 113 in the interior thereof. The material channels 112 are individually communicated with their corresponding material inlets 131, and externally pipe-connected to the material reservoirs 30. Further, the gas channels 113 are individually communicated with their corresponding gas inlets 132, and externally pipe-connected to the gas supplier 35. As a result, the materials and gas can be introduced into the interior chambers 13 through the material channels 112 and the gas channels 113, and then mixed with each other and sprayed out of the ejection holes 14 to perform makeup procedure.

As shown in FIG. 4, in one embodiment, each needle valve 20 includes a central needle valve 21 configured into a shaft-like shape and disposed in its corresponding material channel 112. The diameter of each central needle valve 21 is smaller than width of each material channel 112, such that the materials can flow through the material channels 112. Additionally, the end 211 of each central needle valve 21 extends through the material inlet 131 and is axially aligned with the ejection hole 14.

In this embodiment, each of the needle valves 20 is connected to a micromotor 23. For instance, the micromotor 23 and the needle valve 20 can be connected with each other by a gear assembly (not shown in figures). As a result, the micromotors 23 can drive the needle valves 20 to axially move away from their corresponding ejection holes 14 and thus to open the ejection holes 14, or to axially move closer to their corresponding ejection holes 14 and thus to close the ejection holes 14 (as shown in FIG. 4). Further, all the needle valves 20 may be synchronously driven into axial movement by the micromotors 23 so as to simultaneously open or close the ejection holes 14 of all the nozzles 12. Accordingly, the materials can be more uniformly sprayed, resulting in enhanced makeup effect. Alternatively, the axial movement of the needle valves 20 may be independently driven by their corresponding micromotors 23 to individually open or close the ejection holes 14 of the nozzles 12. By the non-synchronous operation, different materials can be ejected at the same location for different makeup looks or makeup steps so as to reduce the requirement for moving the multi-nozzle spray head 10 and speeding up makeup procedure of the makeup machine 1.

In accordance with one embodiment, each needle valve 20 may be provided with an airtight valve corresponding to each gas inlet 132. Each airtight valve can be operated to open or close its corresponding gas inlet 132. As shown in FIG. 4, in one embodiment, each of the needle valves 20 is configured into a Y-like shape and includes a branched needle valve 22 as an airtight valve. The branched needle valves 22 are formed in a shaft-like shape and disposed in their corresponding gas channels 113. Further, the branched needle valves 22 have a diameter smaller than width of the gas channels 113 so as to allow the gas to flow through the gas channels 113. Additionally, the ends 221 of the branched needle valves 22 are axially aligned with the corresponding gas inlets 132. In this illustration, the branched needle valves 22 are shorter than the central needle valves 21. When the needle valves 20 are driven by the micromotors 23 and axially move away from their corresponding ejection holes 14 to open the ejection holes 14, the branched needle valves 22 would move synchronously with the needle valves 20, resulting in opening of the corresponding gas inlets 132. Accordingly, the gas can be introduced into the interior chambers 13 and mixed with the materials in the interior chambers 13, followed by spraying of the mixture from the ejection holes 14. On the contrary, when the axial movement of the needle valves 20 toward the corresponding ejection holes 14 is driven by the micromotors 23 to close the ejection holes 14, the branched needle valves 22 are synchronously controlled to close the corresponding gas inlets 132, thereby reducing security risks caused by the introduction of gas into the interior chambers 13. In some cases, the gas channel 113 may be coaxially disposed in the material channel 112, and the needle valve 20 can include only the central needle valve 21. The central needle valve 21 extends through both the gas channel 113 and the material channel 112, and the airtight valve is a barrier radially projecting from the central needle valve 21. When the needle valves 20 are driven by the micromotors 23 to axially move, the barriers would synchronously be brought into the axial motion to open or close the corresponding gas inlets 132. This alternative design is not shown in the figures.

In some cases, the gas suppliers 35 of the makeup machine 1 may be controlled by a controller (not shown in the figures) to supply or shut off gas in cooperation with the axial movement of the needle valves 20. Accordingly, the airtight valves can be omitted. For instance, when the needle valves 20 are driven by the micromotors 23 and axially move away from the corresponding ejection holes 14 to open the ejection holes 14, the gas suppliers 35 are operated by the controller to supply gas for spraying the materials out of the corresponding ejection holes 14. On the contrary, when the micromotors 23 drive the needle valves 20 to axially toward the corresponding ejection holes 14, resulting in closing of the ejection holes 14, the controller can shut down the gas supplier 35 to stop supplying gas.

In some cases, the main body 11 and the multiple nozzles 12 of the multi-nozzle spray head 10 may be configured as an integral structure, and all the needle valves 20 also can be in an integral structure. Alternatively, the main body 11 and the multiple nozzles 12 of the multi-nozzle spray head 10 are designed into a modular structure, and each of the needle valves 20 has a multi-segment modular structure. For instance, the central needle valve 21 and the branched needle valve 22 may be separable components, thereby reducing the difficulty in assembly.

As shown in FIG. 4, in accordance with one embodiment, the main body 11 of the multi-nozzle spray head 10 includes a central gas channel 111 communicated with all or parts of the gas inlets 132 of the nozzles 12 and pipe-connected to a gas supplier 35. As a result, the quantity of pipes can be reduced, thereby simplifying the structure of the makeup machine 1 and reducing cost and difficulty in manufacturing the makeup machine 1.

Figure 5:
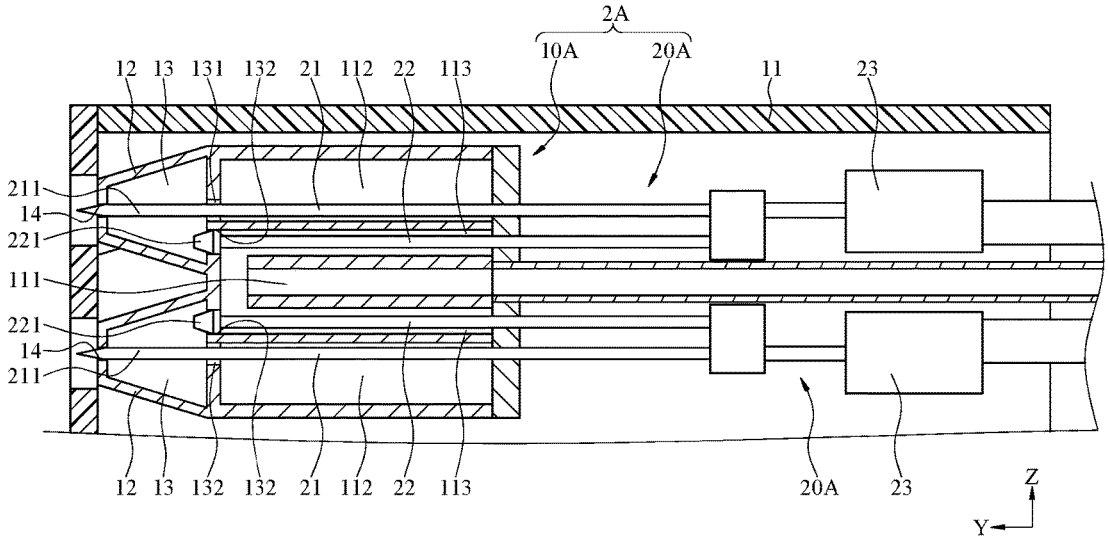
FIG. 5 is a cross-sectional view of a spray head assembly in accordance with the second embodiment of the present invention.

FIG. 5 is a cross-sectional view of a spray head assembly in accordance with the second embodiment of the present invention. As shown in FIG. 5, the spray head assembly 2A of this embodiment is similar to that illustrated in the first embodiment, except that (i) the material inlets 131 of the interior chambers 13 of the multi-nozzle spray head 10A are axially aligned with the corresponding ejection holes 14, (ii) the central needle valves 21 and the branched needle valves 22 of the needle valves 20A are configured to have a straight shaft-like shape, and (iii) the central needle valves 21 axially extend through the corresponding material inlets 131 and axially aligned with the corresponding ejection holes 14. In some cases, the end 211 of the central needle valve 21 or/and the end 221 of the branched needle valve 22 may be conical in shape. Accordingly, the amount of the material sprayed from the ejection holes 14 or the amount of the gas introduced into the gas inlets 132 can be adjusted so as to more precisely control the timing of ejecting the material and the concentration of the material.

FIG. 6 is a perspective view of a spray head assembly in accordance with the third embodiment of the present invention. In FIG. 6, the multi-nozzle spray head 10B of the spray head assembly 2B includes only two nozzles 12 and two needle valves 20B.

Figure 7:
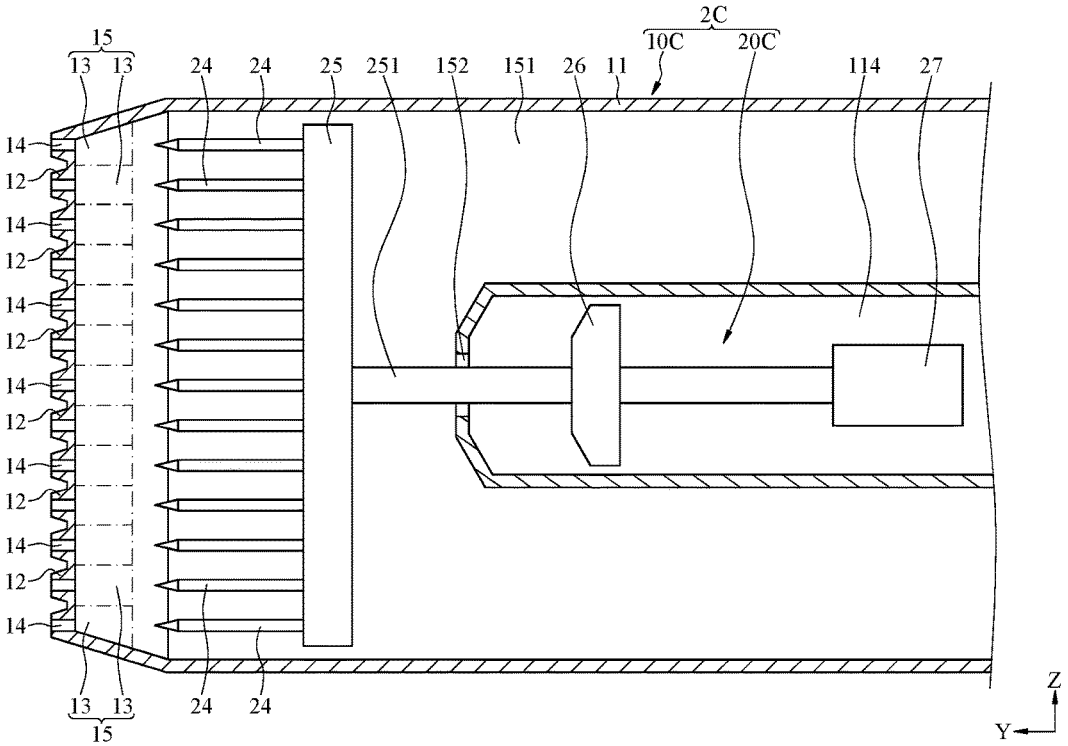
FIG. 7 is a cross-sectional view of a spray head assembly in accordance with the fourth embodiment of the present invention.

FIG. 7 is a cross-sectional view of a spray head assembly in accordance with the fourth embodiment of the present invention. As shown in FIG. 7, the spray head assembly 2C of this embodiment is modified in that all the interior chambers 13 of the nozzles 12 of the multi-nozzle spray head 10C are communicated with each other to form a common chamber 15. In this illustration, the common chamber 15 includes a material inlet 151 and a gas inlet 152. The material inlet 151 and the gas inlet 152 are pipe-connected to a material reservoir 30 and a gas supplier 35, respectively. Accordingly, the material and gas can be introduced into the common chamber 15 through the material inlet 151 and the gas inlet 152 to be mixed with each other and then sprayed out of the ejection holes 14 of the multiple nozzles 12 together. In some cases, the common chamber 15 may include multiple material inlets 151 individually connected to different material reservoirs 30 for supplying different materials. In accordance with one embodiment, the multi-nozzle spray head 10C may be designed like a shower nozzle and includes micro nozzles 12 arranged at one end of the main body 11. As a result, the material can be sprayed out more uniformly.

Additionally, as shown in FIG. 7, in accordance with one embodiment, each of the needle valves 20C of the spray head assemblies 2C can include multiple valve stems 24 and a valve seat 25. The valve seat 25 has a plate-like configuration and is disposed in the interior of the main body 11 and connected to a drive motor 27. The valve stems 24 are connected to the valve seat 25 and configured into a comb-like arrangement and individually aligned with their corresponding ejection holes 14. The drive motor 27 can drive the motion of the valve seat 25 relative to the main body 11. By the movement of the valve seat 25 toward or away from the ejection holes 14, the valve stems 24 can move synchronously with the valve seat 25 to open or close the ejection holes 14.

In accordance with one embodiment, each of the needle valves 20C may further include a breakaway valve 26 aligned with the gas inlet 152 and operable to open or close the corresponding gas inlet 152. As shown in FIG. 7, in this embodiment, the valve seat 25 is connected to the drive motor 27 through a shaft 251, and a gas channel 114 is formed in the main body 11 of the multi-nozzle spray head 10C. The gas inlet 152 is located at one end, adjacent to the ejection holes 14, of the gas channel 114. The breakaway valve 26 can be a barrier and disposed around the shaft 251. When the valve seat 25 is driven by the drive motor 27 to move with respect to the main body 11 and bring the valve stems 24 away from the ejection holes 14, resulting in opening of the ejection holes 14, the breakaway valve 26 would be synchronously brought into the axial motion to open the corresponding gas inlet 152. On the contrary, when the valve seat 25 is driven by the drive motor 27 and then moves with respect to the main body 11 and brings the valve stems 24 toward the ejection holes 14 to close the ejection holes 14, the breakaway valve 26 would move synchronously with the valve seat 25 to close the corresponding gas inlet 152.

Figure 8:
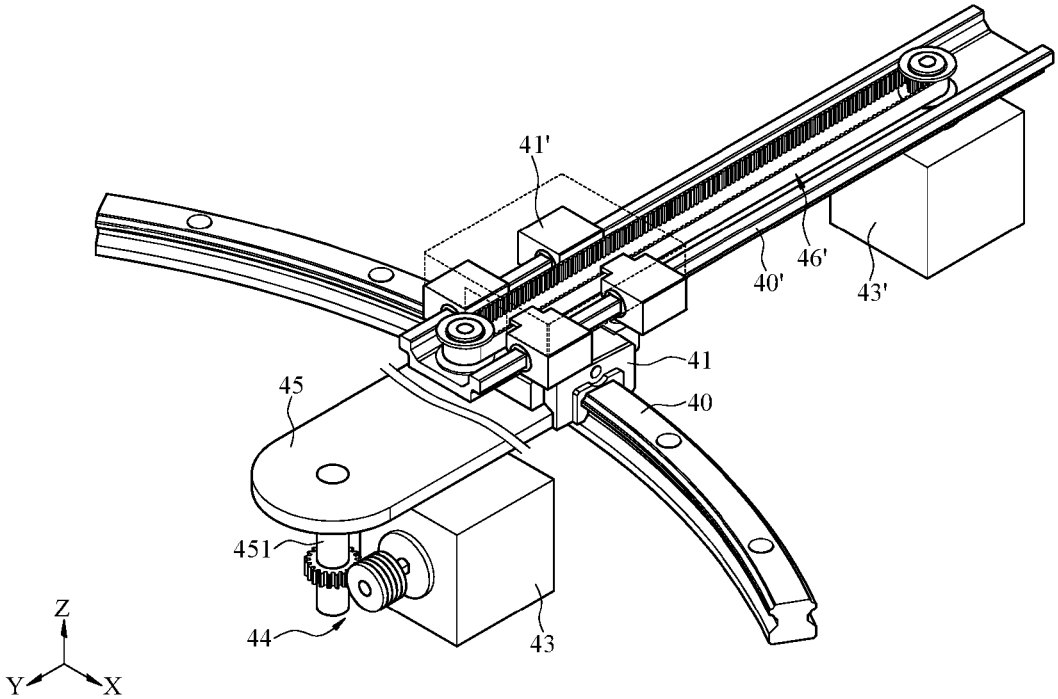
FIG. 8 is a partial perspective view of a makeup machine in accordance with one embodiment of the present invention.

FIG. 8 is a partial perspective view of a makeup machine in accordance with one embodiment of the present invention. As shown in FIG. 8 in conjunction with FIG. 1, the makeup machine 1 includes a lateral track 40 and a sliding block 41. In this embodiment, the lateral track 40 is an arc-shaped track and extends along an X axis. The sliding block 41 is slidably disposed on the lateral track 40, and the standing frame 42 is fastened on the sliding block 41. The sliding block 41 can be connected to and driven by a motor 43 so as to bring the standing frame 42 and the multiple spray head assemblies 2 into curvilinear motion along the lateral track 40. Accordingly, in the makeup procedure by the makeup machine 1, the multiple spray head assemblies 2 can move according to the contour of the user's face so as to effectively reduce the displacement and shorten moving time, resulting in enhanced makeup efficiency and effect and shortened makeup time. In some cases, the lateral track 40 may be an arc-shaped guide groove or an arc-shaped guide shaft.

As shown in FIG. 8, in accordance with one embodiment, the motor 43 can be connected to a central axle 451 of a swing seat 45 by a gear set 44, and the sliding block 41 is fastened to the periphery of the swing seat 45. Accordingly, the motor 43 can drive cranking motion of the swing seat 45 about the central axle 451 so as to bring the sliding block 41 into curvilinear motion along the lateral track 40.

Figure 9:
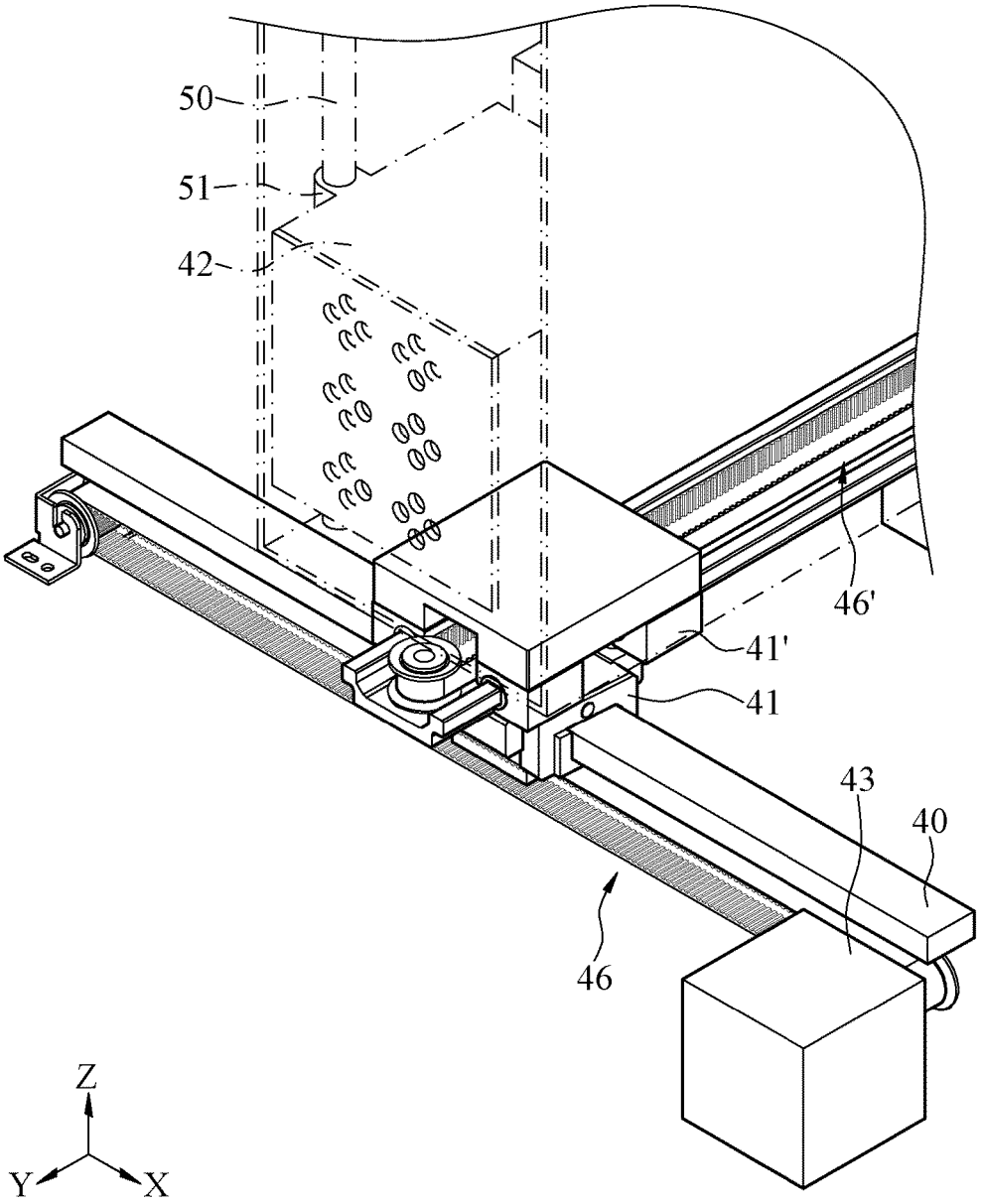
FIG. 9 is a partial perspective view of a makeup machine in accordance with another embodiment of the present invention.

FIG. 9 is a partial perspective view of a makeup machine in accordance with another embodiment of the present invention. As shown in FIG. 9, in this embodiment, the lateral track 40 is a linear track and extends along an X axis. Additionally, the motor 43 is connected to the sliding block 41 through a pulley set 46 and can drive the sliding block 41 to bring the standing frame 42 and the multiple spray head assemblies 2 into linear movement along the lateral track 40.

Please referring back to FIGS. 1 and 8, in accordance with one embodiment, the makeup machine 1 may further include another lateral track 40' extending along a Y axis and another sliding block 41' slidably disposed on the lateral track 40'. Further, the standing frame 42 is also disposed on the sliding block 41'. The sliding block 41' can be driven by another motor 43' to bring the standing frame 42 and the multiple spray head assemblies 2 into sliding motion along the lateral track 40'. Accordingly, the standing frame 42 can move along the X axis or the Y axis. In this embodiment, the motor 43' is connected to the sliding block 41' through another pulley set 46' and can drive the sliding block 41' to linearly move along the lateral track 40'.

Additionally, as shown in FIGS. 1 and 2, in accordance with one embodiment, the makeup machine 1 may further include an elevating track 50 and a sliding block 51. The elevating track 50 is a guide shaft and extends along a Z axis. The sliding block 51 is slidably disposed on the elevating track 50. The standing frame 42 is fastened to the sliding block 51. In this embodiment, the sliding block 51 is connected to a control motor 53 by which the sliding block 51 can be driven to bring the standing frame 42 and the multiple spray head assemblies 2 into up-and-down motion along the elevating track 50. Accordingly, the standing frame 42 can move in three dimensions. In one embodiment, the control motor 53 can be connected to the standing frame 42 through a pulley set 54.

Figure 10:
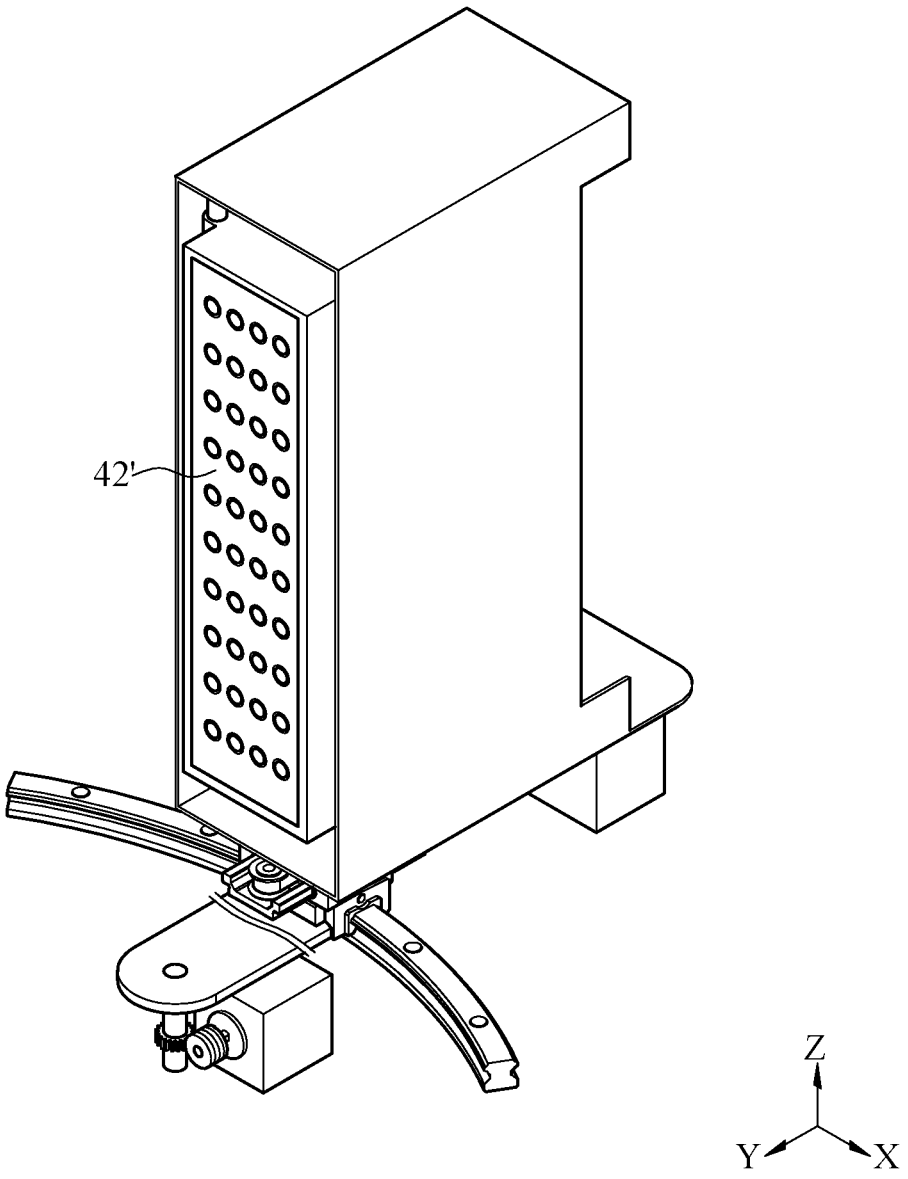
FIG. 10 is a perspective view of a standing frame in accordance with one embodiment of the present invention.

FIG. 10 is a perspective view of a standing frame in accordance with one embodiment of the present invention. As shown in FIG. 10, the standing frame 42' of this embodiment has a vertical length corresponding to the length of a person's face. Accordingly, the makeup machine 1 can be devoid of the elevating track 50 and the sliding block 51, thereby reducing the manufacturing cost of the makeup machine 1 and shortening makeup time.

Figure 11:
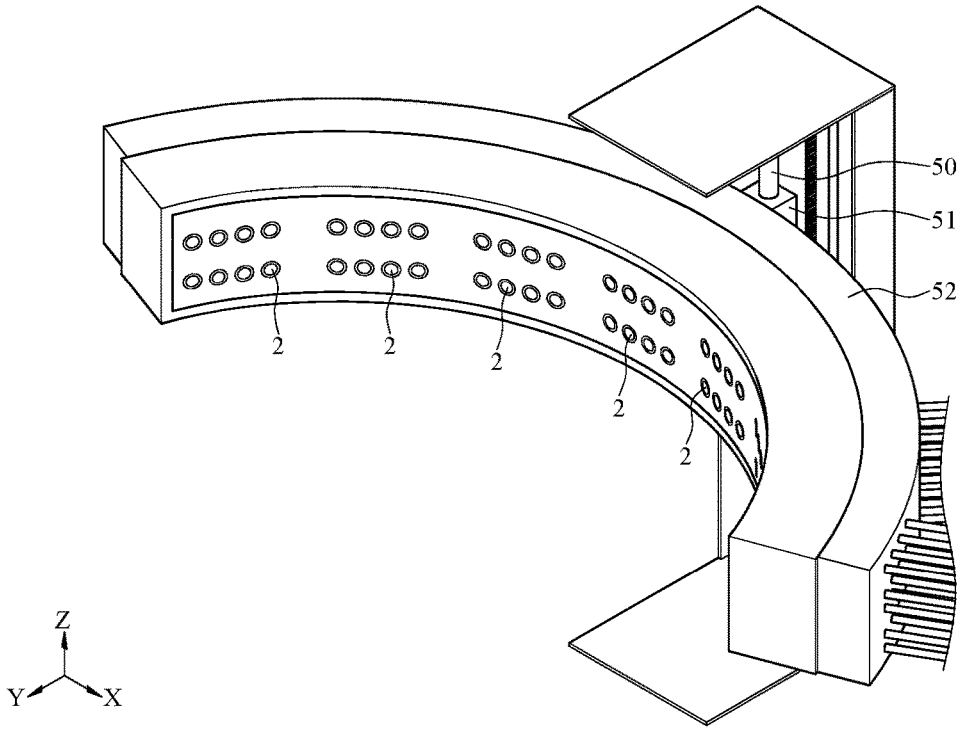
FIG. 11 is a partial perspective view of a makeup machine in accordance with yet another embodiment of the present invention.

FIG. 11 is a partial perspective view of a makeup machine in accordance with another embodiment of the present invention. As shown in FIG. 11, the makeup machine 1 of this embodiment includes an elevating track 50 and a sliding block 51, and a lateral frame 52 can be fastened to the sliding block 51. In this illustration, the lateral frame 52 is an arc-shaped frame, and multiple spray head assemblies 2 are arranged side by side at the lateral frame 52. As the lateral frame 52 is in an arc-shaped configuration, a mechanism for moving spray head assemblies 2 along the X axis is unnecessary for the makeup machine 1. In one case, the lateral frame 52 may be a linear frame.

Figure 12:
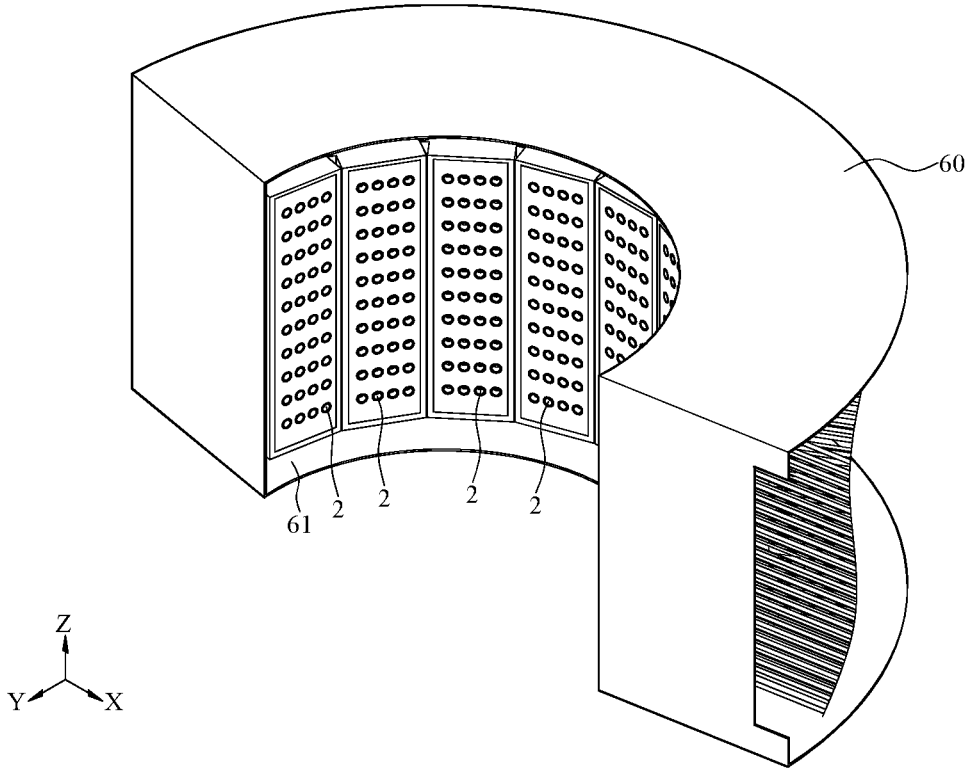
FIG. 12 is a partial perspective view of a makeup machine in accordance with further another embodiment of the present invention.

FIG. 12 is a partial perspective view of a makeup machine in accordance with yet another embodiment of the present invention. As shown in FIG. 12, the makeup machine 1 can includes a fixing frame 60. In this illustration, the fixing frame 60 has an arc-shaped surface 61, and multiple spray head assemblies 2 are stacked and arranged side by side at the fixing frame 60. As a result, a mechanism for moving spray head assemblies 2 along X, Y and Z axes can be omitted for the makeup machine 1, thereby largely reducing the manufacturing cost of the makeup machine 1 and shortening makeup time.

In summary, the makeup machines in accordance with the embodiments of the present invention are advantageous because the multi-nozzle spray head 10 include multiple nozzles 12. Each of which is aligned with a needle valve 20 for controlling the opening or closing of the ejection holes 14. In the makeup procedure, the needle valves 20 can synchronously move with respect to the main body 11 to simultaneously open all the ejection holes 14 of the nozzles 12, resulting in more uniformly spraying of materials. Alternatively, the needle valves 20 may individually move with respect to the main body 11 to independently open the different ejection holes 14 so as to spray different materials at the same location for different makeup looks or makeup steps, thereby reducing the requirement for moving the spray head and speeding up the makeup procedure of the makeup machine 1.

The embodiments described above are provided to illustrate the present invention but not to limit the present invention. Other various modifications and variations can be made without departing from the spirit of the invention and included within the scope of the present invention. Accordingly, the scope of the present invention is defined by the appended claims rather than the forgoing description of embodiments.

What is claimed is:

1. A makeup machine, comprising:

a multi-nozzle spray head, having a main body and a plurality of nozzles, wherein each of the nozzles includes an interior chamber and an ejection hole, and the interior chamber is communicated with the ejection hole, wherein each of the interior chambers includes a material inlet and a gas inlet; and a plurality of needle valves, disposed in the main body and axially aligned with the ejection holes, wherein the needle valves are configured to be axially movable away from the corresponding ejection holes to open the ejection holes and to be axially movable toward the corresponding ejection holes to close the ejection holes, and the needle valves are capable of synchronously or individually moving with respect to the main body.

2. The makeup machine of claim 1, wherein each of the needle valves has an airtight valve, and the airtight valves are individually aligned with the corresponding gas inlets and operable to selectively open or close the corresponding gas inlets.

3. The makeup machine of claim 2, wherein (i) each of the needle valves is configured into a Y-like structure and includes a central needle valve and a branched needle valve as the airtight valve, (ii) when the central needle valve axially moves away from the corresponding ejection hole, the branched needle valve is brought into synchronous motion with the central needle valve to open the corresponding gas inlet, and (iii) when the central needle valve axially moves toward the corresponding ejection hole, the branched needle valve is brought into synchronous motion with the central needle valve to close the corresponding gas inlet.

4. The makeup machine of claim 1, wherein the main body includes a central gas channel communicated with at least two of the gas inlets of the nozzles.

5. The makeup machine of claim 4, wherein the nozzles are arranged at an equal angular interval.

6. The makeup machine of claim 1, further comprising a plurality of material reservoirs, wherein at least two of the material inlets of the multi-nozzle spray head are individually connected to different ones of the material reservoirs.

7. The makeup machine of claim 1, wherein each of the needle valves is connected to a micromotor for imparting axial motion to the needle valve.

8. A makeup machine, comprising:

a multi-nozzle spray head, having a main body and a plurality of nozzles, wherein each of the nozzles includes an interior chamber and an ejection hole, and the interior chamber is communicated with the ejection hole, wherein at least two of the interior chambers of the nozzles are communicated with each other to form a common chamber that includes a material inlet and a gas inlet; and a plurality of needle valves, disposed in the main body and axially aligned with the ejection holes, wherein the needle valves are configured to be axially movable away from the corresponding ejection holes to open the ejection holes and to be axially movable toward the corresponding ejection holes to close the ejection holes, and the needle valves are capable of synchronously or individually moving with respect to the main body.

9. The makeup machine of claim 8, wherein (i) each of the needle valves includes a plurality of valve stems and a valve seat, (ii) the valve stems are individually connected to the valve seat and individually aligned with the corresponding ejection holes, and (iii) the valve seat is connected to a drive motor capable of driving the valve seat to move toward or away from the ejection holes with respect to the main body.

10. The makeup machine of claim 9, wherein each of the needle valves further includes a breakaway valve aligned with the gas inlet, and the breakaway valve is operable to open or close the corresponding gas inlet.

11. The makeup machine of claim 1, wherein each of the needle valves has a conical end.

12. A makeup machine, comprising a plurality of spray head assemblies of which each includes:

a multi-nozzle spray head, having a main body and a plurality of nozzles, wherein each of the nozzles includes an interior chamber and an ejection hole, and the interior chamber is communicated with the ejection hole;

a plurality of needle valves, disposed in the main body and axially aligned with the ejection holes, wherein the needle valves are configured to be axially movable away from the corresponding ejection holes to open the ejection holes and to be axially movable toward the corresponding ejection holes to close the ejection holes, and the needle valves are capable of synchronously or individually moving with respect to the main body; and a fixing frame, wherein the spray head assemblies are arranged side by side and stacked in the fixing frame.

13. The makeup machine of claim 12, further comprising a lateral track and a sliding block, wherein (i) the sliding block is movably disposed on the lateral track, (ii) a standing frame is disposed on the sliding block, and (iii) the spray head assemblies are stacked in the standing frame.

14. The makeup machine of claim 13, wherein the lateral track is an arc-shaped track.

15. The makeup machine of claim 12, further comprising an elevating track and a sliding block, wherein (i) the sliding block is movably disposed on the elevating track, (ii) a lateral frame is disposed on the sliding block, and (iii) the spray head assemblies are arranged side by side in the lateral frame.

16. The makeup machine of claim 15, wherein the lateral frame is an arc-shaped frame.

17. The makeup machine of claim 12, wherein the fixing frame has an arc-shaped surface.

* * * * *